US011046900B2

(12) United States Patent
Housmans et al.

(10) Patent No.: US 11,046,900 B2
(45) Date of Patent: Jun. 29, 2021

(54) PROCESS FOR UPGRADING REFINERY HEAVY RESIDUES TO PETROCHEMICALS

(71) Applicants: SAUDI BASIC INDUSTRIES CORPORATION, Riyadh (SA); SABIC GLOBAL TECHNOLOGIES B.V., Bergen op Zoom (NL); Thomas Hubertus Maria Housmans, Geleen (NL); Arno Johannes Maria Oprins, Maastricht (NL)

(72) Inventors: Thomas Hubertus Maria Housmans, Geleen (NL); Arno Johannes Maria Oprins, Maastricht (NL)

(73) Assignees: SAUDI BASIC INDUSTRIES CORPORATION, Riyadh (SA); SABIC GLOBAL TECHNOLOGIES B.V., Bergen Op Zoom (NL)

( * ) Notice: Subject to any disclaimer, the term of this patent is extended or adjusted under 35 U.S.C. 154(b) by 0 days.

(21) Appl. No.: 14/901,947

(22) PCT Filed: Jun. 30, 2014

(86) PCT No.: PCT/EP2014/063849
§ 371 (c)(1),
(2) Date: Dec. 29, 2015

(87) PCT Pub. No.: WO2015/000841
PCT Pub. Date: Jan. 8, 2015

(65) Prior Publication Data

US 2016/0369188 A1 Dec. 22, 2016

(30) Foreign Application Priority Data

Jul. 2, 2013 (EP) ..... 13174770

(51) Int. Cl.
*C10G 69/06* (2006.01)
*C10G 69/02* (2006.01)
(Continued)

(52) U.S. Cl.
CPC ..... *C10G 69/02* (2013.01); *C10G 65/00* (2013.01); *C10G 65/10* (2013.01); *C10G 65/18* (2013.01);
(Continued)

(58) Field of Classification Search
CPC ..... C10G 65/14; C10G 65/18; C10G 67/04; C10G 67/044; C10G 67/16; C10G 69/02;
(Continued)

(56) References Cited

U.S. PATENT DOCUMENTS 3,080,311 A * 3/1963 Mertes ..... C10G 65/18 208/109
3,132,087 A * 5/1964 Wood ..... C10G 69/10 502/74
(Continued)

FOREIGN PATENT DOCUMENTS

EP 0192059 A1 8/1986
EP 2243814 A1 10/2010
(Continued)

OTHER PUBLICATIONS

How Stuff Works, From Crude Oil—How Oil Refining Works, accessed from <https://science.howstuffworks.com/environmental/energy/oil-refining2.htm> on Apr. 7, 2020. (Year: 2020).*
(Continued)

*Primary Examiner* — Michelle Stein
(74) *Attorney, Agent, or Firm* — Norton Rose Fulbright US LLP

(57) ABSTRACT

The present invention relates to a process for upgrading refinery heavy residues to petrochemicals, comprising the
(Continued)

following steps of: (a) separating a hydrocarbon feedstock in a distillation unit into a to overhead stream and a bottom stream (b) feeding said bottom stream to a hydrocracking reaction area (c) separating reaction products, which are generated from said reaction area of step (b) into a stream rich in mono-aromatics and in a stream rich in poly-aromatics (d) feeding said stream rich in mono-aromatics to a gasoline hydrocracker (GHC) unit, (e) feeding said stream rich in poly-aromatics to a ring opening reaction area.

1 Claim, 1 Drawing Sheet

(51) Int. Cl.

| | |
|---|---|
| ***C10G 65/00*** | (2006.01) |
| ***C10G 65/10*** | (2006.01) |
| ***C10G 65/18*** | (2006.01) |
| ***C10G 67/04*** | (2006.01) |
| ***C10G 69/14*** | (2006.01) |

(52) U.S. Cl.
CPC ..... *C10G 67/0445* (2013.01); *C10G 69/06* (2013.01); *C10G 69/14* (2013.01); *C10G 2300/107* (2013.01); *C10G 2300/1044* (2013.01); *C10G 2300/1051* (2013.01); *C10G 2300/1055* (2013.01); *C10G 2300/1059* (2013.01); *C10G 2300/1077* (2013.01); *C10G 2400/20* (2013.01); *C10G 2400/30* (2013.01)

(58) Field of Classification Search
CPC ..... C10G 69/14; C10G 69/10; C10G 69/08; C10G 65/12; C10G 65/02; C10G 65/08; C10G 45/44
See application file for complete search history.

(56) References Cited

U.S. PATENT DOCUMENTS

| | | | | |
|---|---|---|---|---|
| 3,159,567 | A * | 12/1964 | Young | C10G 47/00 208/110 |
| 3,331,766 | A * | 7/1967 | Young | C10G 65/18 208/110 |
| 3,433,848 | A | 3/1969 | Devins et al. | |
| 3,660,270 | A | 5/1972 | Mason | |
| 3,726,789 | A * | 4/1973 | Kovach et al. | C10G 69/00 208/80 |
| 3,816,294 | A * | 6/1974 | Wilson | C10G 69/123 208/102 |
| 3,842,138 | A * | 10/1974 | Chahvekilian et al. | C10G 47/22 585/501 |
| 3,891,539 | A | 6/1975 | Nelson et al. | |
| 4,137,147 | A | 1/1979 | Franck et al. | |
| 4,192,734 | A | 3/1980 | Pavlica et al. | |
| 4,827,072 | A | 5/1989 | Imai et al. | |
| 4,926,005 | A | 5/1990 | Olbrich et al. | |
| 5,880,325 | A | 3/1999 | Alward et al. | |
| 6,153,087 | A | 11/2000 | Bigeard et al. | |
| 6,270,654 | B1 | 8/2001 | Colyar et al. | |
| 7,067,448 | B1 | 6/2006 | Weitkamp et al. | |
| 7,214,308 | B2 | 5/2007 | Colyar | |
| 7,513,988 | B2 | 4/2009 | Oballa et al. | |
| 7,622,623 | B2 | 11/2009 | Fridman et al. | |
| 7,704,377 | B2 | 4/2010 | Duddy et al. | |
| 7,938,952 | B2 | 5/2011 | Colyar et al. | |
| 8,926,824 | B2 | 1/2015 | Morel | |
| 9,005,430 | B2 | 4/2015 | Fournier et al. | |
| 9,840,674 | B2 | 12/2017 | Weiss et al. | |
| 2005/0101814 | A1 | 5/2005 | Foley et al. | |
| 2005/0183988 | A1 | 8/2005 | Freerks et al. | |
| 2008/0093262 | A1 | 4/2008 | Gragnani et al. | |
| 2008/0194900 | A1 | 8/2008 | Bhirud | |
| 2009/0173665 | A1 | 7/2009 | Zhou et al. | |
| 2012/0261308 | A1 | 10/2012 | Klein et al. | |
| 2014/0299515 | A1 | 10/2014 | Weiss et al. | |
| 2016/0122666 | A1 | 5/2016 | Weiss et al. | |

FOREIGN PATENT DOCUMENTS

| | | | |
|---|---|---|---|
| FR | 2364879 | A1 | 4/1978 |
| GB | 1020595 | A | 2/1966 |
| GB | 2162082 | A | 1/1986 |
| JP | H0 2300291 | | 12/1990 |
| JP | 2000198990 | | 7/2000 |
| JP | 2009179795 | | 8/2009 |
| WO | 0244306 | A1 | 6/2002 |
| WO | 2005073349 | A1 | 8/2005 |
| WO | 2006122275 | A2 | 11/2006 |
| WO | 2007055488 | A1 | 5/2007 |
| WO | 2008092232 | A1 | 8/2008 |
| WO | 2010102712 | A2 | 6/2010 |
| WO | 2011005476 | A2 | 1/2011 |
| WO | 2012135111 | A2 | 10/2012 |
| WO | WO 2011/001914 | | 12/2012 |
| WO | WO 2015/000841 | | 1/2015 |
| WO | WO 2015/000847 | | 1/2015 |
| WO | WO 2016/146326 | | 9/2016 |

OTHER PUBLICATIONS

Alfke et al. (2007) Oil Refining, Ullmann's Encyclopedia of Industrial Chemistry.
English Abstract of WO2010102712(A2); Date of Publication: Sep. 19, 2010; 2 Pages.
Folkins (2000) Benzene, Ullmann's Encyclopedia of Industrial Chemistry.
International Search Report for International Application No. PCT/EP2014/063849; International Filing Date: Jun. 30, 2014; dated Sep. 8, 2014; 5 Pages.
Machine Translation of FR2364879; Date of Publication: Apr. 14, 1978; 26 Pages.
Speight (2005) Petroleum Refinery Process, Kirk-Othmer Encyclopedia of Chemical Technology.
Table VI, p. 295, Pyrolysis: Theory and Industrial Practice by Lyle F. Albright et al., Academic Press 1983.
Written Opinion of the International Searching Authority for International Application No. PCT/EP2014/063849; International Filing Date: Jun. 30, 2014; dated Sep. 8, 2014; 6 Pages.
Pransenjeet Ghosh et al., "Development of a Detailed Gasoline Composition-Based Octane Model," Industrial & Engineering Chemistry Research, vol. 45, No. 1, Jan. 1, 2006, pp. 337-345
Slupek S. et al. "Determination of polycyclic aromatic hydrocarbons in heavy oil flames by gas chromatography-mass spectrometry" Fuel, IPC Science and Technology Press, Guildford, GB, vol. 68, No. 7, Jul. 1, 2989, pp. 877-882.
Office Action issued in corresponding Japanese Patent Application No. 2018-201614, dated Nov. 6, 2019. (Machine Translation Provided).
Office Action issued in counterpart Singaporean Patent Application No. 10201807497V, dated Aug. 21, 2020.

* cited by examiner

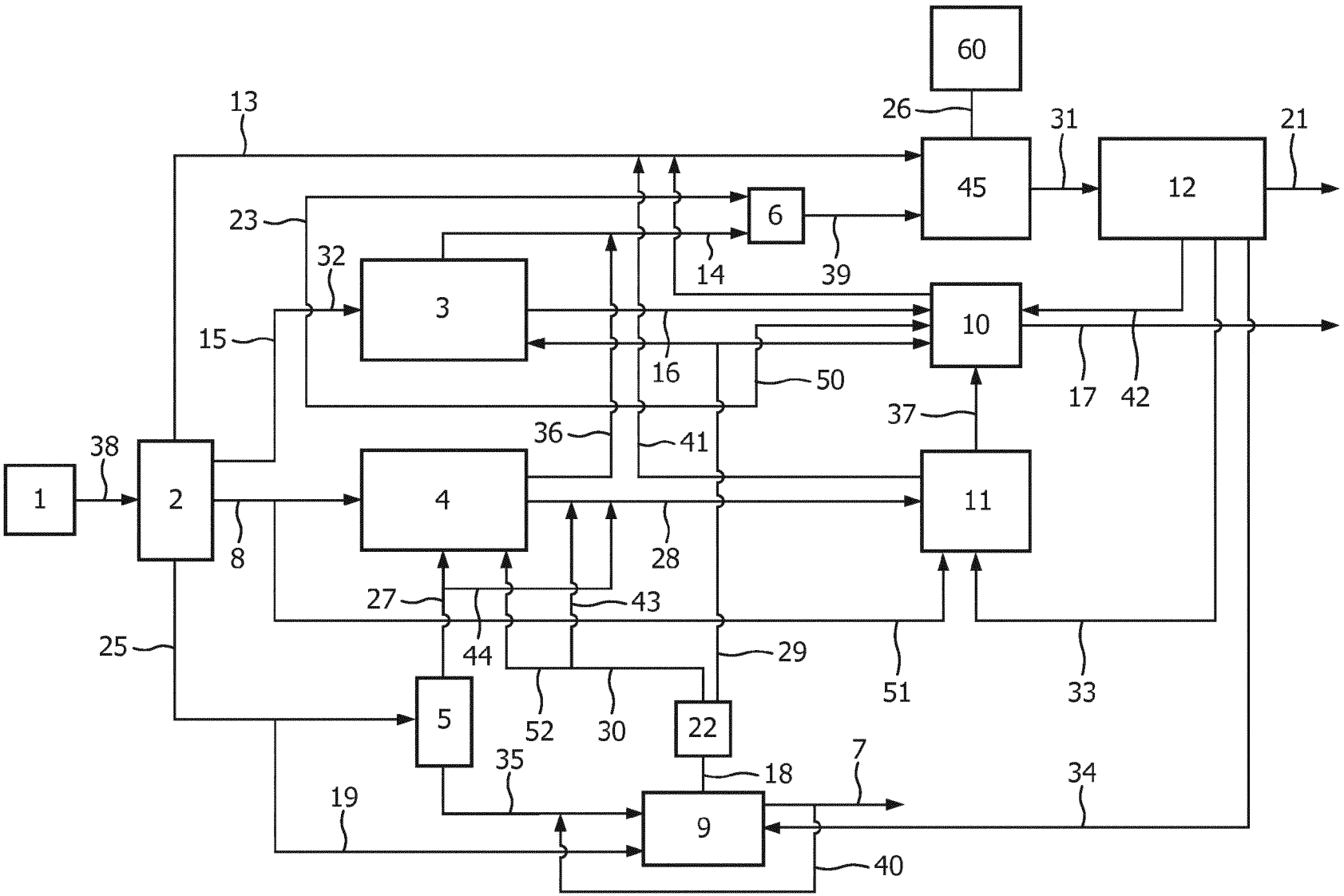
1
2
3
4
5
6
7
8
9
10
11
12
13
14
15
16
17
18
19
21
22
23
25
26
27
28
29
30
31
32
33
34
35
36
37
38
39
40
41
42
43
44
45
50
51
52
60

PROCESS FOR UPGRADING REFINERY HEAVY RESIDUES TO PETROCHEMICALS

CROSS REFERENCE TO RELATED APPLICATIONS

This application is a National Stage application of PCT/EP2014/063849, filed Jun. 30, 2014, which claims the benefit of European Application No. 13174770.1, filed Jul. 2, 2013, both of which are incorporated by reference in their entirety herein.

BACKGROUND OF THE INVENTION

The present invention relates to a process for upgrading refinery heavy residues to petrochemicals.

Conventionally, crude oil is processed, via distillation, into a number of cuts such as naphtha, gas oils and residua. Each of these cuts has a number of potential uses such as for producing transportation fuels such as gasoline, diesel and kerosene or as feeds to some petrochemicals and other processing units.

Light crude oil cuts such a naphthas and some gas oils can be used for producing light olefins and single ring aromatic compounds via processes such as steam cracking in which the hydrocarbon feed stream is evaporated and diluted with steam and then exposed to a very high temperature (800° C. to 860° C.) in short residence time (<1 second) furnace (reactor) tubes. In such a process the hydrocarbon molecules in the feed are transformed into (on average) shorter molecules and molecules with lower hydrogen to carbon ratios (such as olefins) when compared to the feed molecules. This process also generates hydrogen as a useful by-product and significant quantities of lower value co-products such as methane and C9+ Aromatics and condensed aromatic species (containing two or more aromatic rings which share edges).

Typically, the heavier (or higher boiling point) aromatic species, such as residua are further processed in a crude oil refinery to maximize the yields of lighter (distillable) products from the crude oil. This processing can be carried out by processes such as hydro-cracking (whereby the hydrocracker feed is exposed to a suitable catalyst under conditions which result in some fraction of the feed molecules being broken into shorter hydrocarbon molecules with the simultaneous addition of hydrogen). Heavy refinery stream hydrocracking is typically carried out at high pressures and temperatures and thus has a high capital cost.

An aspect of such a combination of crude oil distillation and steam cracking of the lighter distillation cuts is the capital and other costs associated with the fractional distillation of crude oil. Heavier crude oil cuts (i.e. those boiling beyond ~350° C.) are relatively rich in substituted aromatic species and especially substituted condensed aromatic species (containing two or more aromatic rings which share edges) and under steam cracking conditions these materials yield substantial quantities of heavy by products such as C9+ aromatics and condensed aromatics. Hence, a consequence of the conventional combination of crude oil distillation and steam cracking is that a substantial fraction of the crude oil is not processed via the steam cracker as the cracking yield of valuable products from heavier cuts is not considered to be sufficiently high, compared to the alternative refinery fuel value.

Another aspect of the technology discussed above is that even when only light crude oil cuts (such as naphtha) are processed via steam cracking a significant fraction of the feed stream is converted into low value heavy by-products such as C9+ aromatics and condensed aromatics. With typical naphthas and gas oils these heavy by-products might constitute 2 to 25% of the total product yield (Table VI, Page 295, Pyrolysis: Theory and Industrial Practice by Lyle F. Albright et al, Academic Press, 1983). Whilst this represents a significant financial downgrade of expensive naphtha and/or gas oil in lower value material on the scale of a conventional steam cracker the yield of these heavy by-products does not typically justify the capital investment required to up-grade these materials (e.g. by hydrocracking) into streams that might produce significant quantities of higher value chemicals. This is partly because hydrocracking plants have high capital costs and, as with most petrochemicals processes, the capital cost of these units typically scales with throughput raised to the power of 0.6 or 0.7. Consequently, the capital costs of a small scale hydrocracking unit are normally considered to be too high to justify such an investment to process steam cracker heavy by-products.

Another aspect of the conventional hydrocracking of heavy refinery streams such as residua is that these are typically carried out under compromise conditions chosen to achieve the desired overall conversion. As the feed streams contain a mixture of species with a range of ease of cracking this result in some fraction of the distillable products formed by hydrocracking of relatively easily hydrocracked species being further converted under the conditions necessary to hydrocrack species more difficult to hydrocrack. This increases the hydrogen consumption and heat management difficulties associated with the process and also increases the yield of light molecules such as methane at the expense of more valuable species.

A result of such a combination of crude oil distillation and steam cracking of the lighter distillation cuts is that steam cracking furnace tubes are typically unsuitable for the processing of cuts which contain significant quantities of material with a boiling point greater than ~350° C. as it is difficult to ensure complete evaporation of these cuts prior to exposing the mixed hydrocarbon and steam stream to the high temperatures required to promote thermal cracking. If droplets of liquid hydrocarbon are present in the hot sections of cracking tubes coke is rapidly deposited on the tube surface which reduces heat transfer and increases pressure drop and ultimately curtails the operation of the cracking tube necessitating a shut-down of the furnace to allow for decoking. Due to this difficulty a significant portion of the original crude oil cannot be processed into light olefins and aromatic species via a steam cracker.

US2009173665 relates to a catalyst and process for increasing the monoaromatics content of hydrocarbon feedstocks that include polynuclear aromatics, wherein the increase in monoaromatics can be achieved with an increase in gasoline/diesel yields and while reducing unwanted compounds thereby providing a route for upgrading hydrocarbons that include significant quantities of polynuclear aromatics.

International application WO2005/073349 relates to a low severity hydrocracker to initially process waxy feeds heavier than distillate fuels into distillate fuels of lower cloud and/or freeze point as well as a heavy isoparaffinic stream which is suitable for dewaxing, either catalytically or by solvent extraction, to low pour point isoparaffinic base oils of exceptionally high viscosity index and low volatility. The process disclosed in WO2005073349 comprises the steps of: (a) fractionating a feedstock into a first distillate comprising C5 to 160° C. hydrocarbons, and a second distillate comprising 160° C. to 371° C. hydrocarbons, and a third distillate comprising 371° C.+ hydrocarbons; (b) hydrocracking the third distillate in a low severity hydrocracker to produce a hydrocrackate; (c) feeding the second distillate to a second fractionator; (c) feeding the hydrocrackate to the second fractionator; (d) recovering from the second fractionator a first distillate fuel fraction, a light lubricant fraction, and a waxy lubricant fraction; (e) hydrodewaxing the waxy lubricant fraction to form a dewaxed product; (f) fractionating the dewaxed product in a third fractionator.

U.S. Pat. No. 3,891,539 relates to the hydrocracking of heavy hydrocarbon oils having from about 10 to 50 volume percent boiling above 1000° F. and containing appreciable amounts of sulfur, nitrogen, and metal-containing compounds as well as asphaltenes and other coke forming hydrocarbons wherein heavy hydrocarbon oils are converted into a minor fraction of heavy residual fuel oil and a major fraction of low sulfur gasoline.

U.S. Pat. No. 3,660,270 relates to a two-stage process for producing naphtha from petroleum distillates.

U.S. Pat. No. 4,137,147 (corresponding to FR 2 364 879) relates to a selective process for producing light olefinic hydrocarbons chiefly those with 2 and 3 carbon atoms respectively per molecule, particularly ethylene and propylene, which are obtained by hydrogenolysis or hydrocracking followed with steam-cracking.

U.S. Pat. No. 3,842,138 relates to a method of thermal cracking in the presence of hydrogen of a charge of hydrocarbons of petroleum wherein the hydrocracking process is carried out under a pressure of 5 and 70 bars at the outlet of the reactor with very short residence times of 0.01 and 0.5 second and a temperature range at the outlet of the reactor extending from 625 to 1000° C. The LCO Unicracking process of UOP uses partial conversion hydrocracking to produce high quality gasoline and diesel stocks in a simple once-through flow scheme. The feedstock is processed over a pretreatment catalyst and then hydrocracked in the same stage. The products are subsequently separated without the need for liquid recycle. The LCO Unicracking process can be designed for lower pressure operation, that is the pressure requirement will be somewhat higher than high severity hydrotreating but significantly lower than a conventional partial conversion and full conversion hydrocracking unit design. The upgraded middle distillate product makes a suitable ultra-low sulfur diesel (ULSD) blending component. The naphtha product from low-pressure hydrocracking of LCO has ultra-low sulfur and high octane and can be directly blended into the ultra-low sulfur gasoline (ULSG) pool.

U.S. Pat. No. 7,513,988 relates to a process to treat compounds comprising two or more fused aromatic rings to saturate at least one ring and then cleave the resulting saturated ring from the aromatic portion of the compound to produce a C2-4 alkane stream and an aromatic stream. Such a process may be integrated with a hydrocarbon (e.g. ethylene) (steam) cracker so that hydrogen from the cracker may be used to saturate and cleave the compounds comprising two or more aromatic rings and the C2-4 alkane stream may be fed to the hydrocarbon cracker, or may be integrated with a hydrocarbon cracker (e.g. steam cracker) and an ethylbenzene unit, that is to treat the heavy residues from processing oil sands, tar sands, shale oils or any oil having a high content of fused ring aromatic compounds to produce a stream suitable for petrochemical production.

US2005/0101814 relates to a process for improving the paraffin content of a feedstock to a steam cracking unit, comprising: passing a feedstream comprising C5 through C9 hydrocarbons including C5 through C9 normal paraffins into a ring opening reactor, the ring opening reactor comprising a catalyst operated at conditions to convert aromatic hydrocarbons to naphtenes and a catalyst operated at conditions to convert naphtenes to paraffins, and producing a second feedstream; and passing at least a portion of the second feedstream to a steam cracking unit.

U.S. Pat. No. 7,067,448 relates to a process for the manufacture of n-alkanes from mineral oil fractions and fractions from thermal or catalytic conversion plants containing cyclic alkanes, alkenes, cyclic alkenes and/or aromatic compounds. More in detail, this publication refers to a process for processing mineral oil fractions rich in aromatic compounds, in which the cyclic alkanes obtained after the hydrogenation of the aromatic compounds are converted to n-alkanes of a chain length which as far as possible is less than that of the charged carbons.

US2009/173665 relates to a catalyst and process for increasing the monoaromatics content of hydrocarbon feedstocks that include polynuclear aromatics, wherein the increase in monoaromatics can be achieved with an increase in gasoline/diesel yields and while reducing unwanted compounds thereby providing a route for upgrading hydrocarbons that include significant quantities of polynuclear aromatics.

The LCO-process as discussed above relates to full conversion hydrocracking of LCO to naphtha, in which LCO is a mono-aromatics and di-aromatics containing stream. A consequence of the full conversion hydrocracking is that a highly naphthenic, low octane naphtha is obtained that must be reformed to produce the octane required for product blending.

WO2006/122275 relates to a process for upgrading a heavy hydrocarbon crude oil feedstock into an oil that is less dense or lighter and contains lower sulfur than the original heavy hydrocarbon crude oil feedstock while making value added materials such as olefins and aromatics, which process comprises, inter alia, the steps of: combining a portion of the heavy hydrocarbon crude oil with an oil soluble catalyst to form a reactant mixture, reacting the pretreated feedstock under relatively low hydrogen pressure to form a product stream, wherein a first portion of the product stream includes a light oil and a second portion of the product stream includes a heavy crude oil residue, and a third portion of the product stream includes a light hydrocarbon gas, and injecting a portion of the light hydrocarbon gas stream in a cracking unit to produce streams containing hydrogen and at least one olefin.

WO2011005476 relates to a process for the treatment of heavy oils, including crude oils, vacuum residue, tar sands, bitumen and vacuum gas oils using a catalytic hydrotreating pretreatment process, specifically the use of hydrodemetallization (HDM) and hydrodesulphurization (HDS) catalysts in series in order to improve the efficiency of a subsequent coker refinery.

US2008/194900 relates to an olefins process for steam cracking an aromatics-containing naphtha stream comprising: recovering olefins and pyrolysis gasoline streams from a steam cracking furnace effluent, hydrogenating the pyrolysis gasoline stream and recovering a C6-C8 stream therefrom, hydrotreating an aromatics-containing naphtha stream to obtain a naphtha feed, dearomatizing the C6-C8 stream with the naphtha feed stream in a common aromatics extraction unit to obtain a raffinate stream; and feeding the raffinate stream to the steam cracking furnace.

WO2008092232 relates to a process for extraction of chemical components from a feedstock, such as a petroleum, natural gas condensate, or petrochemical feedstock, a whole range naphtha feedstock comprising the steps of: subjecting the whole range naphtha feedstock to a desulphurizing process, separating from the desulphurized whole range naphtha feedstock a C6 to C11 hydrocarbon fraction, recovering from the C6 to C11 hydrocarbon fraction an aromatics fraction, an aromatics precursors fraction and a raffinate fraction in an aromatics extraction unit, converting aromatics precursors in the aromatics precursors fraction to aromatics, and recovering aromatics from step in the aromatics extraction unit.

OBJECT OF THE INVENTION

An object of the present invention is to provide a method for upgrading naphtha, gas condensates and heavy tail feeds to aromatics and LPG cracker feeds.

Another object of the present invention is to provide a process for the production of light olefins and aromatics from a hydrocarbon feedstock in which a high yield of ethylene and propylene can be attained.

Another object of the present invention is to provide a process for the production of light olefins and aromatics from a hydrocarbon feedstock in which a broad spectrum of hydrocarbon feedstocks can be processed, i.e. a high feed flexibility.

Another object of the present invention is to provide a process for the production of light olefins and aromatics from a hydrocarbon feedstock in which a high yield of aromatics can be attained.

Another object of the present invention is to provide a process for upgrading of a crude oil feedstock to petrochemicals, more specifically light olefins and BTX/mono-aromatics.

Another object of the present invention is to provide a process for upgrading of a crude oil feedstock to petrochemicals with a high carbon efficiency and hydrogen integration.

BRIEF DESCRIPTION OF THE FIGURE

The Figure shows an embodiment of a process according to the invention.

DETAILED DESCRIPTION

The present invention relates to a process for upgrading refinery heavy residues to petrochemicals, comprising the following steps of:

(a) separating a hydrocarbon feedstock in a distillation unit into a to overhead stream and a bottom stream (b) feeding said bottom stream to a hydrocracking reaction area (c) separating reaction products, which are generated from said reaction area of step(b) into a stream rich in mono-aromatics and in a stream rich in poly-aromatics (d) feeding said stream rich in mono-aromatics to a gasoline hydrocracker (GHC) unit, (e) feeding said stream rich in poly-aromatics to a ring opening reaction area, wherein said gasoline hydrocracker (GHC) unit is operated at a temperature higher than said ring opening reaction area, and wherein said gasoline hydrocracker (GHC) unit is operated at a pressure lower than said ring opening reaction area.

On basis of these steps (a)-(e) one or more of the objects can be attained. The present inventors found that hydrogen integration with steam cracker or dehydrogenation results in much lower cost for hydrogen production compared to a refinery as the petrochemical products (light olefins and BTX) contain less hydrogen compared to gasoline and diesel, therefore the combined process is much more economical in terms of hydrogen management.

According to the present invention resid hydrocracking technology is applied to convert the vacuum residue type of material not possible to process in above mentioned way into several product streams roughly corresponding to LPG, a mostly mono-aromatic stream, a mostly di-/tri-aromatic stream and a stream containing mostly higher poly-aromatic compounds. Unlike typical application in refinery operation where the most important goal is the upgrading to specific naphtha, gasoline or diesel fractions and maximization of one or more of these specific yields the present inventors are optimizing the resid hydrocracking unit to minimize coke/pitch formation and methane production. The resulting effluent is then further upgraded taking into account the number of molecular rings in the individual compounds and to separate them accordingly (only via boiling range or also by applying e.g. de-aromatization technology (possibly only separating out n-paraffin components)). These streams are then most efficiently upgraded depending on their "number of rings" in either a GHC unit (mono-aromatics) to maximize BTX production and minimize hydrogen consumption; in a ring opening hydrocracking unit (di/tri aromatics) as the production of gasoline/diesel is not key to produce petrochemicals; in a recycle of the very heavy product to the resid hydrocracker itself of the tri/tetra+ ring components possibly having a bleed stream. Alternatively a resid FCC unit can be applied in a similar way replacing the resid hydrocracker (or even resid hydrocracker and VDU) but this is likely to result in higher carbon losses to methane and coke compared to a resid hydrocracker, however at a lower investment in return.

The effluent of the ring-opening process is highly mono-aromatic and then fed to the GHC unit for further upgrading into LPG (high value stream for steam cracker and/or PDH/BDH) and BTX (high purity). If no de-aromatization (or similar) is included between the different hydrocracking steps the process becomes a sequential hydrocracking cascade of reactors (or single/combined reactor concepts) and additional benefits can be obtained by only reducing the pressure required in each section rather than having to flash the effluent and recompress each time. This will have significant energy advantages but adds some additional volume to the later processing steps due to higher gas loading.

Preferably the streams originating from the different unit operations are recycled to the unit that has a similar feed composition, i.e. LCO like materials go via the ring opening process, possibly after de-aromatization or similar; mono-aromatic streams like the highly aromatic naphtha produced would go into the GHC unit et cetera. In particular the heavier (lower value) streams like C9 fraction, CD and CBO from steam cracker operation will also preferably be recycled to the resid hydrocracker (mostly for carbon black oil, CBO) and ring-opening process (mostly for C9+ fraction and cracked distillates, CD) to maximize high value chemical yields.

The present inventors found that using 'standard' hydrocracking for ring opening naphthenic species are converted to paraffins at the cost of BTX production and increased hydrogen consumption. For producing maximum ethylene via steam cracking (possibly after reverse-isomerization) or propylene via PDH this can be desired but otherwise there is a distinct advantage in sending the naphthenic rich streams via a GHC unit. This way naphthenics are converted into BTX (maximizing) and hydrogen addition is minimized.

For the process described here there is no express need to separate for example the LPG, gasoline and diesel fractions as such. Mono-aromatics and LPG can for example be sent to a GHC unit together. This avoids having to condensate and separate (part) of this stream and the LPG will have no adverse effect on the GHC performance or will even aid evaporation of the feed. Combination of the ring-opening process with the GHC reactor results in further benefits and can avoid the intermediate separation steps in total (at the cost of a slightly bigger GHC unit). The ultimate form of this integration is the sequential hydrocracking concept or integrated reactor concept.

Further optimization include applying de-aromatization, de-n paraffinization, de-paraffinization et cetera; applying reversed isomerization to increase ethylene yields, PDH and BDH to increase the overall carbon efficiency. In specific embodiments, elimination of the VDU, inclusion of DCU as an alternative to heavy/VR upgrading, FCC and combinations thereof similar to normal refinery optimization can be replacing the resid hydrocracker.

If only gas cracking and/or PDH/BDH are the most desirable the entire naphtha and lighter cut (mono-aromatic or less) can be send to a FHC unit (or after de-aromatization to a GHC). In a preferred embodiment, the middle cut has to pass through the ring-opening process and the effluent then added to the mono-aromatic feed to the FHC or GHC unit (possibly two separate units in practice).

On basis of the present invention, that is a combination of a resid hydrocracker (or full conversion hydrocracker), a ring opening reactor and the GHC process, one can now fully upgrade an entire crude feed into only light olefins and BTX using the appropriate conversion process based on the concentration of mono, di, tri and higher ringed structures in the respective boiling ranges possibly aided by other separation techniques like de-aromatization/extraction.

The process as set forth above further comprises separating reaction products of said GHC of step (c) into an overhead stream, which contains hydrogen, methane, ethane, and liquefied petroleum gas, and a bottom stream, which contains aromatic hydrocarbon compounds, and a small amount of hydrogen and non-aromatic hydrocarbon compounds, According to another embodiment it is further preferred feeding the overhead stream from the gasoline hydrocracker (GHC) unit into a steam cracker unit, preferably after separation, i.e. without hydrogen and methane, which components will normally not be send to the furnaces but downstream.

According to a preferred embodiment the separation in step (c) is carried out such that said stream rich in mono-aromatics comprising mono-aromatics having a boiling range of from 70° C. to 217° C. is fed to said gasoline hydrocracker (GHC) unit and said stream rich in poly-aromatics comprising poly-aromatics having a boiling range of from 217° C. and higher is fed to said ring opening reaction area.

As discussed above, said stream rich in poly-aromatics of step (b) is pretreated in an aromatics extraction unit, from which aromatics extraction unit its bottom stream is fed into said reaction area for ringopening and its overhead stream is fed into said steam cracker unit.

Such an aromatics extraction unit is preferably of the type of a distillation unit, or of the type of a solvent extraction unit, or a combination thereof. According to another embodiment the aromatics extraction unit is operated with molecular sieves In the case of a solvent extraction unit its overhead stream is washed for removal of solvent, wherein the thus recovered solvent is returned into said solvent extraction unit and the overhead stream thus washed being fed into said steam cracker unit.

In a preferred embodiment said bottom stream from said distillation unit is pretreated in a vacuum distillation unit (VDU), in which vacuum distillation unit said feed is separated in an overhead stream and a bottom stream, and feeding said bottom stream into said hydrocracking area of step (b), further comprising feeding said overhead stream to said aromatics extraction unit.

The present process further comprises feeding said overhead stream of said distillation unit of step (a) to a separation section, in which separation section said overhead stream being separated in a stream rich in aromatics and a stream rich in paraffins, wherein preferably said stream rich in paraffins is fed to said steam cracker unit and said stream rich in aromatics is fed to said gasoline hydrocracker (GHC).

According to a preferred embodiment the present further comprises separating reaction products of said steam cracking unit into an overhead stream, comprising C2-C6 alkanes, a middle stream, comprising C2=, C3= and C4=, and a bottom stream, comprising aromatic hydrocarbon compounds, non-aromatic hydrocarbon compounds and C9+, especially further comprising returning said overhead stream to said steam cracking unit and further comprising separating said bottom stream into pygas and a stream containing C9+, carbon black oil (CBO) and cracked distillates (CD). The middle stream refers in principle to the high-value products. The hydrogen and methane are mainly present in the middle stream and these components can be separated from the middle stream and can be used for other purposes in the present method.

The CBO and CD containing stream can be sent to the reaction area for ring opening and/or to the hydrocracking reaction area of step (b).

Said pygas is preferably sent into said gasoline hydrocracker (GHC) unit of step (c).

The bottom stream from reaction products of said gasoline hydrocracker (GHC) unit is preferably separated in a BTX rich fraction and in heavy fraction, wherein said overhead stream from the gasoline hydrocracker (GHC) unit is preferably sent to a dehydrogenation unit. It is preferred to send only the C3-C4 fraction to the dehydrogenation unit.

As discussed above in connection with the hydrogen economics its is preferred to recover hydrogen from the reaction products of said steam cracking unit and feeding the hydrogen thus recovered to said gasoline hydrocracker (GHC) unit and/or said reaction area for ring opening and/or to the resid hydrocracking unit. In addition, its is preferred to recover hydrogen from said dehydrogenation unit and feeding the hydrogen thus recovered to said gasoline hydrocracker (GHC) unit and/or said reaction area for ring opening and/or to the resid hydrocracking unit.

The process conditions prevailing in said reaction area for ring opening are a temperature from 100[deg.] C. to 500 [deg.] C. and a pressure from 2 to 10 MPa together with from 50 to 300 kg of hydrogen per 1,000 kg of feedstock over an aromatic hydrogenation catalyst and passing the resulting stream to a ring cleavage unit at a temperature from 200 [deg.] C. to 600[deg.] C. and a pressure from 1 to 12 MPa together with from 50 to 200 kg of hydrogen per 1,000 kg of said resulting stream over a ring cleavage catalyst.

According to a preferred embodiment the present process further comprises returning a high content poly aromatics stream from the reaction area for ring opening to said hydrocracking area, in addition to feeding a high content mono aromatics stream from the reaction area for ring opening to said gasoline hydrocracker (GHC) unit of step (c).

The process conditions prevailing in said gasoline hydrocracker (GHC) unit are a reaction temperature of 300-580° C., preferable of 450-580° C., more preferable of 470-550° C., a pressure of 0.3-5 MPa gauge, preferably at a pressure of 0.6-3 MPa gauge, particularly preferable at a pressure of 1000-2000 kPa MPa gauge most preferable at a pressure of 1-2 MPa gauge, most preferable at a pressure of 1.2-16 Mpa gauge, a Weight Hourly Space Velocity (WHSV) of 0.1-10 h−1, preferable of 0.2-6 h−1, more preferable of 0.4-2 h−1.

The process conditions prevailing in said steam cracking unit are a reaction temperature around 750-900° C., residence times of 50-1000 milliseconds and a pressure selected of atmospheric up to 175 kPa gauge.

The process conditions prevailing in said hydrocracking area of step (b) are a temperature of 300-580° C., a pressure of 300-5000 kPa gauge and a Weight Hourly Space Velocity of 0.1-10 h−1, preferable a temperature of 300-450° C., a pressure of 300-5000 kPa gauge and a Weight Hourly Space Velocity of 0.1-10 h−1, more preferable a temperature of 300-400° C., a pressure of 600-3000 kPa gauge and a Weight Hourly Space Velocity of 0.2-2 h−1.

The hydrocarbon feedstock of step (a) is chosen form the group of crude oil, kerosene, diesel, atmospheric gas oil (AGO), gas condensates, waxes, crude contaminated naphtha, vacuum gas oil (VGO), vacuum residue, atmospheric residue, naphtha and pretreated naphtha, or a combination thereof.

The present invention further relates to the use of a gaseous light fraction of a multi stage ring opened hydrocracked hydrocarbon feedstock as a feedstock for a steam cracking unit.

The term "crude oil" as used herein refers to the petroleum extracted from geologic formations in its unrefined form. Any crude oil is suitable as the source material for the process of this invention, including Arabian Heavy, Arabian Light, other Gulf crudes, Brent, North Sea crudes, North and West African crudes, Indonesian, Chinese crudes and mixtures thereof, but also shale oil, tar sands and bio-based oils. The crude oil is preferably conventional petroleum having an API gravity of more than 20° API as measured by the ASTM D287 standard. More preferably, the crude oil used is a light crude oil having an API gravity of more than 30° API. Most preferably, the crude oil comprises Arabian Light Crude Oil. Arabian Light Crude Oil typically has an API gravity of between 32-36° API and a sulfur content of between 1.5-4.5 wt-%.

The term "petrochemicals" or "petrochemical products" as used herein relates to chemical products derived from crude oil that are not used as fuels. Petrochemical products include olefins and aromatics that are used as a basic feedstock for producing chemicals and polymers. High-value petrochemicals include olefins and aromatics. Typical high-value olefins include, but are not limited to, ethylene, propylene, butadiene, butylene-1, isobutylene, isoprene, cyclopentadiene and styrene. Typical high-value aromatics include, but are not limited to, benzene, toluene, xylene and ethyl benzene.

The term "fuels" as used herein relates to crude oil-derived products used as energy carrier. Unlike petrochemicals, which are a collection of well-defined compounds, fuels typically are complex mixtures of different hydrocarbon compounds. Fuels commonly produced by oil refineries include, but are not limited to, gasoline, jet fuel, diesel fuel, heavy fuel oil and petroleum coke.

The term "gases produced by the crude distillation unit" or "gases fraction" as used herein refers to the fraction obtained in a crude oil distillation process that is gaseous at ambient temperatures. Accordingly, the "gases fraction" derived by crude distillation mainly comprises C1-C4 hydrocarbons and may further comprise impurities such as hydrogen sulfide and carbon dioxide. In this specification, other petroleum fractions obtained by crude oil distillation are referred to as "naphtha", "kerosene", "gasoil" and "resid". The terms naphtha, kerosene, gasoil and resid are used herein having their generally accepted meaning in the field of petroleum refinery processes; see Alfke et al. (2007) Oil Refining, Ullmann's Encyclopedia of Industrial Chemistry and Speight (2005) Petroleum Refinery Processes, Kirk-Othmer Encyclopedia of Chemical Technology. In this respect, it is to be noted that there may be overlap between the different crude oil distillation fractions due to the complex mixture of the hydrocarbon compounds comprised in the crude oil and the technical limits to the crude oil distillation process. Preferably, the term "naphtha" as used herein relates to the petroleum fraction obtained by crude oil distillation having a boiling point range of about 20-200° C., more preferably of about 30-190° C. Preferably, light naphtha is the fraction having a boiling point range of about 20-100° C., more preferably of about 30-90° C. Heavy naphtha preferably has a boiling point range of about 80-200° C., more preferably of about 90-190° C. Preferably, the term "kerosene" as used herein relates to the petroleum fraction obtained by crude oil distillation having a boiling point range of about 180-270° C., more preferably of about 190-260° C. Preferably, the term "gasoil" as used herein relates to the petroleum fraction obtained by crude oil distillation having a boiling point range of about 250-360° C., more preferably of about 260-350° C. Preferably, the term "resid" as used herein relates to the petroleum fraction obtained by crude oil distillation having a boiling point of more than about 340° C., more preferably of more than about 350° C.

As used herein, the term "refinery unit" relates to a section of a petrochemical plant complex for the conversion of crude oil to petrochemicals and fuels. In this respect, it is to be noted that a unit for olefins synthesis, such as a steam cracker, is also considered to represent a "refinery unit". In this specification, different hydrocarbons streams produced by refinery units or produced in refinery unit operations are referred to as: refinery unit-derived gases, refinery unit-derived light-distillate, refinery unit-derived middle-distillate and refinery unit-derived heavy-distillate. The term "refinery unit-derived gases" relates to the fraction of the products produced in a refinery unit that is gaseous at ambient temperatures. Accordingly, the refinery unit-derived gas stream may comprise gaseous compounds such as LPGand methane. Other components comprised in the refinery unit-derived gas stream may be hydrogen and hydrogen sulfide. The terms light-distillate, middle-distillate and heavy-distillate are used herein having their generally accepted meaning in the field of petroleum refinery processes; see Speight, J. G. (2005) loc.cit. In this respect, it is to be noted that there may be overlap between different distillation fractions due to the complex mixture of the hydrocarbon compounds comprised in the product stream produced by refinery unit operations and the technical limits to the distillation process used to separate the different fractions. Preferably, the refinery-unit derived light-distillate is the hydrocarbon distillate obtained in a refinery unit process having a boiling point range of about 20-200° C., more preferably of about 30-190° C. The "light-distillate" is often relatively rich in aromatic hydrocarbons having one aromatic ring. Preferably, the refinery-unit derived middle-distillate is the hydrocarbon distillate obtained in a refinery unit process having a boiling point range of about 180-360° C., more preferably of about 190-350° C. The "middle-distillate" is relatively rich in aromatic hydrocarbons having two aromatic rings. Preferably, the refinery-unit derived heavy-distillate is the hydrocarbon distillate obtained in a refinery unit process having a boiling point of more than about 340° C., more preferably of more than about 350° C. The "heavy-distillate" is relatively rich in hydrocarbons having condensed aromatic rings.

The term "aromatic hydrocarbons" or "aromatics" is very well known in the art. Accordingly, the term "aromatic hydrocarbon" relates to cyclically conjugated hydrocarbon with a stability (due to delocalization) that is significantly greater than that of a hypothetical localized structure (e.g. Kekule structure). The most common method for determining aromaticity of a given hydrocarbon is the observation of diatropicity in the 1H NMR spectrum, for example the presence of chemical shifts in the range of from 7.2 to 7.3 ppm for benzene ring protons.

The terms "naphthenic hydrocarbons" or "naphthenes" or "cycloalkanes" is used herein having its established meaning and accordingly relates types of alkanes that have one or more rings of carbon atoms in the chemical structure of their molecules.

The term "olefin" is used herein having its well-established meaning. Accordingly, olefin relates to an unsaturated hydrocarbon compound containing at least one carboncarbon double bond. Preferably, the term "olefins" relates to a mixture comprising two or more of ethylene, propylene, butadiene, butylene-1, isobutylene, isoprene and cyclopentadiene.

The term "LPG" as used herein refers to the well-established acronym for the term "liquefied petroleum gas". LPG generally consists of a blend of C2-C4 hydrocarbons i.e. a mixture of C2, C3, and C4 hydrocarbons.

The term "BTX" as used herein relates to a mixture of benzene, toluene and xylenes.

As used herein, the term "C# hydrocarbons", wherein "#" is a positive integer, is meant to describe all hydrocarbons having # carbon atoms. Moreover, the term "C#+ hydrocarbons" is meant to describe all hydrocarbon molecules having # or more carbon atoms. Accordingly, the term "C5+ hydrocarbons" is meant to describe a mixture of hydrocarbons having 5 or more carbon atoms. The term "C5+ alkanes" accordingly relates to alkanes having 5 or more carbon atoms.

As used herein, the term "crude distillation unit" or "crude oil distillation unit" relates to the fractionating column that is used to separate crude oil into fractions by fractional distillation; see Alfke et al. (2007) loc.cit. Preferably, the crude oil is processed in an atmospheric distillation unit to separate gas oil and lighter fractions from higher boiling components (atmospheric residuum or "resid"). It is not required to pass the resid to a vacuum distillation unit for further fractionation of the resid, and it is possible to process the resid as a single fraction. In case of relatively heavy crude oil feeds, however, it may be advantageous to further fractionate the resid using a vacuum distillation unit to further separate the resid into a vacuum gas oil fraction and vacuum residue fraction. In case vacuum distillation is used, the vacuum gas oil fraction and vacuum residue fraction may be processed separately in the subsequent refinery units. For instance, the vacuum residue fraction may be specifically subjected to solvent deasphalting before further processing.

As used herein, the term "hydrocracker unit" or "hydrocracker" relates to a refinery unit in which a hydrocracking process is performed i.e. a catalytic cracking process assisted by the presence of an elevated partial pressure of hydrogen; see e.g. Alfke et al. (2007) loc.cit. The products of this process are saturated hydrocarbons and, depending on the reaction conditions such as temperature, pressure and space velocity and catalyst activity, aromatic hydrocarbons including BTX. The process conditions used for hydrocracking generally includes a process temperature of 200-600° C., elevated pressures of 0.2-20 MPa, space velocities between 0.1-10 $h^{-1}$ Hydrocracking reactions proceed through a bifunctional mechanism which requires a acid function, which provides for the cracking and isomerization and which provides breaking and/or rearrangement of the carbon-carbon bonds comprised in the hydrocarbon compounds comprised in the feed, and a hydrogenation function. Many catalysts used for the hydrocracking process are formed by composting various transition metals, or metal sulfides with the solid support such as alumina, silica, alumina-silica, magnesia and zeolites.

As used herein, the term "gasoline hydrocracking unit" or "GHC" refers to a refinery unit for performing a hydrocracking process suitable for converting a complex hydrocarbon feed that is relatively rich in aromatic hydrocarbon compounds—such as refinery unit-derived light-distillate including, but not limited to, reformer gasoline, FCC gasoline and pyrolysis gasoline (pygas)- to LPG and BTX, wherein said process is optimized to keep one aromatic ring intact of the aromatics comprised in the GHC feedstream, but to remove most of the side-chains from said aromatic ring. Accordingly, the main product produced by gasoline hydrocracking is BTX and the process can be optimized to provide chemicals-grade BTX. Preferably, the hydrocarbon feed that is subject to gasoline hydrocracking comprises refinery unit-derived light-distillate. More preferably, the hydrocarbon feed that is subjected to gasoline hydrocracking preferably does not comprise more than 1 wt-% of hydrocarbons having more than one aromatic ring. Preferably, the gasoline hydrocracking conditions include a temperature of 300-580° C., more preferably of 450-580° C. and even more preferably of 470-550° C. Lower temperatures must be avoided since hydrogenation of the aromatic ring becomes favorable. However, in case the catalyst comprises a further element that reduces the hydrogenation activity of the catalyst, such as tin, lead or bismuth, lower temperatures may be selected for gasoline hydrocracking; see e.g. WO 02/44306 A1 and WO 2007/055488. In case the reaction temperature is too high, the yield of LPG's (especially propane and butanes) declines and the yield of methane rises. As the catalyst activity may decline over the lifetime of the catalyst, it is advantageous to increase the reactor temperature gradually over the life time of the catalyst to maintain the hydrocracking conversion rate. This means that the optimum temperature at the start of an operating cycle preferably is at the lower end of the hydrocracking temperature range. The optimum reactor temperature will rise as the catalyst deactivates so that at the end of a cycle (shortly before the catalyst is replaced or regenerated) the temperature preferably is selected at the higher end of the hydrocracking temperature range.

Preferably, the gasoline hydrocracking of a hydrocarbon feedstream is performed at a pressure of 0.3-5 MPa gauge, more preferably at a pressure of 0.6-3 MPa gauge, particularly preferably at a pressure of 1-2 MPa gauge and most preferably at a pressure of 1.2-1.6 MPa gauge. By increasing reactor pressure, conversion of C5+ non-aromatics can be increased, but this also increases the yield of methane and the hydrogenation of aromatic rings to cyclohexane species which can be cracked to LPG species. This results in a reduction in aromatic yield as the pressure is increased and, as some cyclohexane and its isomer methylcyclopentane, are not fully hydrocracked, there is an optimum in the purity of the resultant benzene at a pressure of 1.2-1.6 MPa.

Preferably, gasoline hydrocracking of a hydrocarbon feedstream is performed at a Weight Hourly Space Velocity (WHSV) of 0.1-10 $h^{-1}$, more preferably at a Weight Hourly Space Velocity of 0.2-6 $h^{-1}$ and most preferably at a Weight Hourly Space Velocity of 0.4-2 $h^{-1}$. When the space velocity is too high, not all BTX co-boiling paraffin components are hydrocracked, so it will not be possible to achieve BTX specification by simple distillation of the reactor product. At too low space velocity the yield of methane rises at the expense of propane and butane. By selecting the optimal Weight Hourly Space Velocity, it was surprisingly found that sufficiently complete reaction of the benzene co-boilers is achieved to produce on spec BTX without the need for a liquid recycle.

Accordingly, preferred gasoline hydrocracking conditions thus include a temperature of 450-580° C., a pressure of 0.3-5 MPa gauge and a Weight Hourly Space Velocity of 0.1-10 $h^{-1}$. More preferred gasoline hydrocracking conditions include a temperature of 470-550° C., a pressure of 0.6-3 MPa gauge and a Weight Hourly Space Velocity of 0.2-6 $h^{-1}$. Particularly preferred gasoline hydrocracking conditions include a temperature of 470-550° C., a pressure of 1-2 MPa gauge and a Weight Hourly Space Velocity of 0.4-2 $h^{-1}$.

The "aromatic ring opening unit" refers to a refinery unit wherein the aromatic ring opening process is performed. Aromatic ring opening is a specific hydrocracking process that is particularly suitable for converting a feed that is relatively rich in aromatic hydrocarbon having a boiling point in the kerosene and gasoil boiling point range to produce LPG and, depending on the process conditions, a light-distillate (ARO-derived gasoline). Such an aromatic ring opening process (ARO process) is for instance described in U.S. Pat. Nos. 3,256,176 and 4,789,457. Such processes may comprise of either a single fixed bed catalytic reactor or two such reactors in series together with one or more fractionation units to separate desired products from unconverted material and may also incorporate the ability to recycle unconverted material to one or both of the reactors. Reactors may be operated at a temperature of 200-600° C., preferably 300-400° C., a pressure of 3-35 MPa, preferably 5 to 20 MPa together with 5-20 wt-% of hydrogen (in relation to the hydrocarbon feedstock), wherein said hydrogen may flow co-current with the hydrocarbon feedstock or counter current to the direction of flow of the hydrocarbon feedstock, in the presence of a dual functional catalyst active for both hydrogenation-dehydrogenation and ring cleavage, wherein said aromatic ring saturation and ring cleavage may be performed. Catalysts used in such processes comprise one or more elements selected from the group consisting of Pd, Rh, Ru, Ir, Os, Cu, Co, Ni, Pt, Fe, Zn, Ga, In, Mo, W and V in metallic or metal sulphide form supported on an acidic solid such as alumina, silica, alumina-silica and zeolites. In this respect, it is to be noted that the term "supported on" as used herein includes any conventional way to provide a catalyst which combines one or more elements with a catalytic support. A further aromatic ring opening process (ARO process) is described in U.S. Pat. No. 7,513,988. Accordingly, the ARO process may comprise aromatic ring saturation at a temperature of 100-500° C., preferably 200-500° C. and more preferably 300-500° C., a pressure of 2-10 MPa together with 5-30 wt-%, preferably 10-30 wt-% of hydrogen (in relation to the hydrocarbon feedstock) in the presence of an aromatic hydrogenation catalyst and ring cleavage at a temperature of 200-600° C., preferably 300-400° C., a pressure of 1-12 MPa together with 5-20 wt-% of hydrogen (in relation to the hydrocarbon feedstock) in the presence of a ring cleavage catalyst, wherein said aromatic ring saturation and ring cleavage may be performed in one reactor or in two consecutive reactors. The aromatic hydrogenation catalyst may be a conventional hydrogenation/hydrotreating catalyst such as a catalyst comprising a mixture of Ni, W and Mo on a refractory support, typically alumina. The ring cleavage catalyst comprises a transition metal or metal sulphide component and a support. Preferably the catalyst comprises one or more elements selected from the group consisting of Pd, Rh, Ru, Ir, Os, Cu, Co, Ni, Pt, Fe, Zn, Ga, In, Mo, W and V in metallic or metal sulphide form supported on an acidic solid such as alumina, silica, alumina-silica and zeolites. By adapting either single or in combination the catalyst composition, operating temperature, operating space velocity and/or hydrogen partial pressure, the process can be steered towards full saturation and subsequent cleavage of all rings or towards keeping one aromatic ring unsaturated and subsequent cleavage of all but one ring. In the latter case, the ARO process produces a light-distillate ("ARO-gasoline") which is relatively rich in hydrocarbon compounds having one aromatic ring.

As used herein, the term "resid upgrading unit" relates to a refinery unit suitable for the process of resid upgrading, which is a process for breaking the hydrocarbons comprised in the resid and/or refinery unit-derived heavy-distillate into lower boiling point hydrocarbons; see Alfke et al. (2007) loc.cit. Commercially available technologies include a delayed coker, a fluid coker, a resid FCC, a Flexicoker, a visbreaker or a catalytic hydrovisbreaker. Preferably, the resid upgrading unit may be a coking unit or a resid hydrocracker. A "coking unit" is an oil refinery processing unit that converts resid into LPG, light distillate, middle-distillate, heavy-distillate and petroleum coke. The process thermally cracks the long chain hydrocarbon molecules in the residual oil feed into shorter chain molecules.

A "resid hydrocracker" is an oil refinery processing unit that is suitable for the process of resid hydrocracking, which is a process to convert resid into LPG, light distillate, middle-distillate and heavy-distillate. Resid hydrocracking processes are well known in the art; see e.g. Alfke et al. (2007) loc.cit. Accordingly, 3 basic reactor types are employed in commercial hydrocracking which are a fixed bed (trickle bed) reactor type, an ebullated bed reactor type and slurry (entrained flow) reactor type. Fixed bed resid hydrocracking processes are well-established and are capable of processing contaminated streams such as atmospheric residues and vacuum residues to produce light- and middle-distillate which can be further processed to produce olefins and aromatics. The catalysts used in fixed bed resid hydrocracking processes commonly comprise one or more elements selected from the group consisting of Co, Mo and Ni on a refractory support, typically alumina. In case of highly contaminated feeds, the catalyst in fixed bed resid hydrocracking processes may also be replenished to a certain extend (moving bed). The process conditions commonly comprise a temperature of 350-450° C. and a pressure of 2-20 MPa gauge. Ebullated bed resid hydrocracking processes are also well-established and are inter alia characterized in that the catalyst is continuously replaced allowing the processing of highly contaminated feeds. The catalysts used in ebullated bed resid hydrocracking processes commonly comprise one or more elements selected from the group consisting of Co, Mo and Ni on a refractory support, typically alumina. The small particle size of the catalysts employed effectively increases their activity (c.f. similar formulations in forms suitable for fixed bed applications). These two factors allow ebullated hydrocracking processes to achieve significantly higher yields of light products and higher levels of hydrogen addition when compared to fixed bed hydrocracking units. The process conditions commonly comprise a temperature of 350-450° C. and a pressure of 5-25 MPa gauge. Slurry resid hydrocracking processes represent a combination of thermal cracking and catalytic hydrogenation to achieve high yields of distillable products from highly contaminated resid feeds. In the first liquid stage, thermal cracking and hydrocracking reactions occur simultaneously in the fluidized bed at process conditions that include a temperature of 400-500° C. and a pressure of 15-25 MPa gauge. Resid, hydrogen and catalyst are introduced at the bottom of the reactor and a fluidized bed is formed, the height of which depends on flow rate and desired conversion. In these processes catalyst is continuously replaced to achieve consistent conversion levels through an operating cycle. The catalyst may be an unsupported metal sulfide that is generated in situ within the reactor. In practice the additional costs associated with the ebullated bed and slurry phase reactors are only justified when a high conversion of highly contaminated heavy streams such as vacuum gas oils is required. Under these circumstances the limited conversion of very large molecules and the difficulties associated with catalyst deactivation make fixed bed processes relatively. Accordingly, ebullated bed and slurry reactor types are preferred due to their improved yield of light- and middle-distillate when compared to fixed bed hydrocracking. As used herein, the term "resid upgrading liquid effluent" relates to the product produced by resid upgrading excluding the gaseous products, such as methane and LPG and the heavy distillate produced by resid upgrading. The heavy-distillate produced by resid upgrading is preferably recycled to the resid upgrading unit until extinction. However, it may be necessary to purge a relatively small pitch stream. From the viewpoint of carbon efficiency, a resid hydrocracker is preferred over a coking unit as the latter produces considerable amounts of petroleum coke that cannot be upgraded to high value petrochemical products. From the viewpoint of the hydrogen balance of the integrated process, it may be preferred to select a coking unit over a resid hydrocracker as the latter consumes considerable amounts of hydrogen. Also in view of the capital expenditure and/or the operating costs it may be advantageous to select a coking unit over a resid hydrocracker.

As used herein, the term "dearomatization unit" relates to a refinery unit for the separation of aromatic hydrocarbons, such as BTX, from a mixed hydrocarbon feed. Such dearomatization processes are described in Folkins (2000) Benzene, Ullmann's Encyclopedia of Industrial Chemistry. Accordingly, processes exist to separate a mixed hydrocarbon stream into a first stream that is enriched for aromatics and a second stream that is enriched for paraffins and naphthenes. A preferred method to separate aromatic hydrocarbons from a mixture of aromatic and aliphatic hydrocarbons is solvent extraction; see e.g. WO 2012135111 A2. The preferred solvents used in aromatic solvent extraction are sulfolane, tetraethylene glycol and N-methylpyrolidone which are commonly used solvents in commercial aromatics extraction processes. These species are often used in combination with other solvents or other chemicals (sometimes called co-solvents) such as water and/or alcohols. Non-nitrogen containing solvents such as sulfolane are particularly preferred. Commercially applied dearomatization processes are less preferred for the dearomatization of hydrocarbon mixtures having a boiling point range that exceeds 250° C., preferably 200° C., as the boiling point of the solvent used in such solvent extraction needs to be lower than the boiling point of the aromatic compounds to be extracted. Solvent extraction of heavy aromatics is described in the art; see e.g. U.S. Pat. No. 5,880,325. Alternatively, other known methods than solvent extraction, such as molecular sieve separation or separation based on boiling point, can be applied for the separation of heavy aromatics in a dearomatization process.

A process to separate a mixed hydrocarbon stream into a stream comprising predominantly paraffins and a second stream comprising predominantly aromatics and naphthenes comprises processing said mixed hydrocarbon stream in a solvent extraction unit comprising three main hydrocarbon processing columns: solvent extraction column, stripper column and extract column. Conventional solvents selective for the extraction of aromatics are also selective for dissolving light naphthenic and to a lesser extent light paraffinic species hence the stream exiting the base of the solvent extraction column comprises solvent together with dissolved aromatic, naphthenic and light paraffinic species. The stream exiting the top of the solvent extraction column (often termed the raffinate stream) comprises the relatively insoluble, with respect to the chosen solvent) paraffinic species. The stream exiting the base of the solvent extraction column is then subjected, in a distillation column, to evaporative stripping in which species are separated on the basis of their relative volatility in the presence of the solvent. In the presence of a solvent, light paraffinic species have higher relative volatilities than naphthenic species and especially aromatic species with the same number of carbon atoms, hence the majority of light paraffinic species may be concentrated in the overhead stream from the evaporative stripping column. This stream may be combined with the raffinate stream from the solvent extraction column or collected as a separate light hydrocarbon stream. Due to their relatively low volatility the majority of the naphthenic and especially aromatic species are retained in the combined solvent and dissolved hydrocarbon stream exiting the base of this column. In the final hydrocarbon processing column of the extraction unit, the solvent is separated from the dissolved hydrocarbon species by distillation. In this step the solvent, which has a relatively high boiling point, is recovered as the base stream from the column whilst the dissolved hydrocarbons, comprising mainly aromatics and naphthenic species, are recovered as the vapour stream exiting the top of the column. This latter stream is often termed the extract.

As used herein, the term "reverse isomerization unit" relates to a refinery unit that is operated to convert isoparaffins comprised in a naphtha and/or a refinery unit-derived light-distillate to normal paraffins. Such a reverse isomerization process is closely related to the more conventional isomerization process to increase the octane rating of gasoline fuels and is inter alia described EP 2 243 814 A1. The feedstream to a reverse isomerization unit preferably is relatively rich in paraffins, preferably isoparaffins, e.g. by removing the aromatics and naphthenes by dearomatization and/or by converting the aromatics and naphthenes to paraffins using a ring opening process. The effect of treating highly paraffinic naphtha in a reverse isomerization unit is that by the conversion of isoparaffins to normal paraffins, the yield of ethylene in a steam cracking process is increased while reducing the yields of methane, C4 hydrocarbons and pyrolysis gasoline. The process conditions for reverse isomerization preferably include a temperature of 50-350° C., preferably of 150-250° C., a pressure of 0.1-10 MPa gauge, preferably of 0.5-4 MPa gauge and a liquid hour space velocity of 0.2-15 volumes of reverse-isomerizable hydrocarbon feed per hour per volume of catalyst, preferably of 0.5-5 hr−1. Any catalyst known in the art to be suitable for the isomerization of paraffin-rich hydrocarbon streams may be used as a reverse-isomerization catalyst. Preferably, the reverse isomerization catalyst comprises a Group 10 element supported on a zeolite and/or a refractory support, such as alumina.

The process of the present invention may require removal of sulfur from certain crude oil fractions to prevent catalyst deactivation in downstream refinery processes, such as catalytic reforming or fluid catalytic cracking. Such a hydrodesulfurization process is performed in a "HDS unit" or "hydrotreater"; see Alfke (2007) loc. cit. Generally, the hydrodesulfurization reaction takes place in a fixed-bed reactor at elevated temperatures of 200-425° C., preferably of 300-400° C. and elevated pressures of 1-20 MPa gauge, preferably 1-13 MPa gauge in the presence of a catalyst comprising elements selected from the group consisting of Ni, Mo, Co, W and Pt, with or without promoters, supported on alumina, wherein the catalyst is in a sulfide form.

In a further embodiment, the process further comprises a hydrodealkylation step wherein the BTX (or only the toluene and xylenes fraction of said BTX produced) is contacted with hydrogen under conditions suitable to produce a hydrodealkylation product stream comprising benzene and fuel gas. The process step for producing benzene from BTX may include a step wherein the benzene comprised in the hydrocracking product stream is separated from the toluene and xylenes before hydrodealkylation. The advantage of this separation step is that the capacity of the hydrodealkylation reactor is increased. The benzene can be separated from the BTX stream by conventional distillation.

Processes for hydrodealkylation of hydrocarbon mixtures comprising C6-C9 aromatic hydrocarbons are well known in the art and include thermal hydrodealkylation and catalytic hydrodealkylation; see e.g. WO 2010/102712 A2. Catalytic hydrodealkylation is preferred as this hydrodealkylation process generally has a higher selectivity towards benzene than thermal hydrodealkylation. Preferably catalytic hydrodealkylation is employed, wherein the hydrodealkylation catalyst is selected from the group consisting of supported chromium oxide catalyst, supported molybdenum oxide catalyst, platinum on silica or alumina and platinum oxide on silica or alumina.

The process conditions useful for hydrodealkylation, also described herein as "hydrodealkylation conditions", can be easily determined by the person skilled in the art. The process conditions used for thermal hydrodealkylation are for instance described in DE 1668719 A1 and include a temperature of 600-800° C., a pressure of 3-10 MPa gauge and a reaction time of 15-45 seconds. The process conditions used for the preferred catalytic hydrodealkylation are described in WO 2010/102712 A2 and preferably include a temperature of 500-650° C., a pressure of 3.5-8 MPa gauge, preferably of 3.5-7 MPa gauge and a Weight Hourly Space Velocity of 0.5-2 h−1. The hydrodealkylation product stream is typically separated into a liquid stream (containing benzene and other aromatics species) and a gas stream (containing hydrogen, H2S, methane and other low boiling point hydrocarbons) by a combination of cooling and distillation. The liquid stream may be further separated, by distillation, into a benzene stream, a C7 to C9 aromatics stream and optionally a middle-distillate stream that is relatively rich in aromatics. The C7 to C9 aromatic stream may be fed back to reactor section as a recycle to increase overall conversion and benzene yield. The aromatic stream which contains polyaromatic species such as biphenyl, is preferably not recycled to the reactor but may be exported as a separate product stream and recycled to the integrated process as middle-distillate ("middle-distillate produced by hydrodealkylation"). The gas stream contains significant quantities of hydrogen may be recycled back the hydrodealkylation unit via a recycle gas compressor or to any other refinery that uses hydrogen as a feed. A recycle gas purge may be used to control the concentrations of methane and H2S in the reactor feed.

As used herein, the term "gas separation unit" relates to the refinery unit that separates different compounds comprised in the gases produced by the crude distillation unit and/or refinery unit-derived gases. Compounds that may be separated to separate streams in the gas separation unit comprise ethane, propane, butanes, hydrogen and fuel gas mainly comprising methane. Any conventional method suitable for the separation of said gases may be employed. Accordingly, the gases may be subjected to multiple compression stages wherein acid gases such as CO2 and H2S may be removed between compression stages. In a following step, the gases produced may be partially condensed over stages of a cascade refrigeration system to about where only the hydrogen remains in the gaseous phase. The different hydrocarbon compounds may subsequently be separated by distillation.

A process for the conversion of alkanes to olefins involves "steam cracking" or "pyrolysis". As used herein, the term "steam cracking" relates to a petrochemical process in which saturated hydrocarbons are broken down into smaller, often unsaturated, hydrocarbons such as ethylene and propylene. In steam cracking gaseous hydrocarbon feeds like ethane, propane and butanes, or mixtures thereof, (gas cracking) or liquid hydrocarbon feeds like naphtha or gasoil (liquid cracking) is diluted with steam and briefly heated in a furnace without the presence of oxygen. Typically, the reaction temperature is 750-900° C., but the reaction is only allowed to take place very briefly, usually with residence times of 50-1000 milliseconds. Preferably, a relatively low process pressure is to be selected of atmospheric up to 175 kPa gauge. Preferably, the hydrocarbon compounds ethane, propane and butanes are separately cracked in accordingly specialized furnaces to ensure cracking at optimal conditions. After the cracking temperature has been reached, the gas is quickly quenched to stop the reaction in a transfer line heat exchanger or inside a quenching header using quench oil. Steam cracking results in the slow deposition of coke, a form of carbon, on the reactor walls. Decoking requires the furnace to be isolated from the process and then a flow of steam or a steam/air mixture is passed through the furnace coils. This converts the hard solid carbon layer to carbon monoxide and carbon dioxide. Once this reaction is complete, the furnace is returned to service. The products produced by steam cracking depend on the composition of the feed, the hydrocarbon to steam ratio and on the cracking temperature and furnace residence time. Light hydrocarbon feeds such as ethane, propane, butane or light naphtha give product streams rich in the lighter polymer grade olefins, including ethylene, propylene, and butadiene. Heavier hydrocarbon (full range and heavy naphtha and gas oil fractions) also give products rich in aromatic hydrocarbons.

To separate the different hydrocarbon compounds produced by steam cracking the cracked gas is subjected to a fractionation unit. Such fractionation units are well known in the art and may comprise a so-called gasoline fractionator where the heavy-distillate ("carbon black oil") and the middle-distillate ("cracked distillate") are separated from the light-distillate and the gases. In the subsequent optional quench tower, most of the light-distillate produced by steam cracking ("pyrolysis gasoline" or "pygas") may be separated from the gases by condensing the light-distillate. Subsequently, the gases may be subjected to multiple compression stages wherein the remainder of the light distillate may be separated from the gases between the compression stages. Also acid gases (CO2 and H2S) may be removed between compression stages. In a following step, the gases produced by pyrolysis may be partially condensed over stages of a cascade refrigeration system to about where only the hydrogen remains in the gaseous phase. The different hydrocarbon compounds may subsequently be separated by simple distillation, wherein the ethylene, propylene and C4 olefins are the most important high-value chemicals produced by steam cracking. The methane produced by steam cracking is generally used as fuel gas, the hydrogen may be separated and recycled to processes that consume hydrogen, such as hydrocracking processes. The acetylene produced by steam cracking preferably is selectively hydrogenated to ethylene. The alkanes comprised in the cracked gas may be recycled to the process for olefins synthesis.

The term "propane dehydrogenation unit" as used herein relates to a petrochemical process unit wherein a propane feedstream is converted into a product comprising propylene and hydrogen. Accordingly, the term "butane dehydrogenation unit" relates to a process unit for converting a butane feedstream into C4 olefins. Together, processes for the dehydrogenation of lower alkanes such as propane and butanes are described as lower alkane dehydrogenation process. Processes for the dehydrogenation of lower alkanes are well-known in the art and include oxidative dehydrogenation processes and non-oxidative dehydrogenation processes. In an oxidative dehydrogenation process, the process heat is provided by partial oxidation of the lower alkane(s) in the feed. In a non-oxidative dehydrogenation process, which is preferred in the context of the present invention, the process heat for the endothermic dehydrogenation reaction is provided by external heat sources such as hot flue gases obtained by burning of fuel gas or steam. In a non-oxidative dehydrogenation process the process conditions generally comprise a temperature of 540-700° C. and an absolute pressure of 25-500 kPa. For instance, the UOP Oleflex process allows for the dehydrogenation of propane to form propylene and of (iso)butane to form (iso)butylene (or mixtures thereof) in the presence of catalyst containing platinum supported on alumina in a moving bed reactor; see e.g. U.S. Pat. No. 4,827,072. The Uhde STAR process allows for the dehydrogenation of propane to form propylene or of butane to form butylene in the presence of a promoted platinum catalyst supported on a zinc-alumina spinel; see e.g. U.S. Pat. No. 4,926,005. The STAR process has been recently improved by applying the principle of oxydehydrogenation. In a secondary adiabatic zone in the reactor part of the hydrogen from the intermediate product is selectively converted with added oxygen to form water. This shifts the thermodynamic equilibrium to higher conversion and achieves a higher yield. Also the external heat required for the endothermic dehydrogenation reaction is partly supplied by the exothermic hydrogen conversion. The Lummus Catofin process employs a number of fixed bed reactors operating on a cyclical basis. The catalyst is activated alumina impregnated with 18-20 wt-% chromium; see e.g. EP 0 192 059 A1 and GB 2 162 082 A. The Catofin process has the advantage that it is robust and capable of handling impurities which would poison a platinum catalyst. The products produced by a butane dehydrogenation process depends on the nature of the butane feed and the butane dehydrogenation process used. Also the Catofin process allows for the dehydrogenation of butane to form butylene; see e.g. U.S. Pat. No. 7,622,623.

The present invention will be discussed in the next Example which example should not be interpreted as limiting the scope of protection.

EXAMPLE

The process scheme can be found in the sole FIGURE. Hydrocarbon feedstock 38 is separated in a distillation unit 2 in overhead streams 15, 13, a bottom stream 25 and a side stream 8. Bottom stream 25, via stream 19, is sent into a hydrocracking reaction area 9 and its reaction products 18 are separated in separator 22 into a stream 29 rich in mono-aromatics and in a stream 30 rich in poly-aromatics. A gas stream (not shown) coming from either hydrocracking reaction area 9 or separator 22 can be sent directly to steam cracker unit 12, possibly via stream 13. Non hydrocracked or incomplete hydrocracked parts stream 7 can be recycled as stream 40 to the inlet of hydrocracking reaction area 9. Stream 29 rich in mono-aromatics is fed to a gasoline hydrocracker (GHC) unit 10 and stream 30 rich in poly-aromatics is fed, via stream 43, to a ring opening reaction area 11. In another embodiment stream 29 is sent to a separation section 3. Side stream 8 from distillation unit 2 can be sent, via stream 51, to ring opening reaction area 11 as well. Another option is to send side stream 8 from distillation unit 2 to an aromatics extraction unit 4.

The reaction products of the GHC unit 10 are separated into an overhead gas stream 24 comprising C2-C4 paraffins, hydrogen and methane and a bottom stream 17 comprising aromatic hydrocarbon compounds and non-aromatic hydrocarbon compounds, which bottom stream 17 can be further upgraded, if necessary, in a stream high in BTX. The overhead gas stream 24 can be further upgraded in separate streams comprising C2-C4 paraffins, hydrogen and methane respectively.

The overhead stream 24 from the gasoline hydrocracker (GHC) unit 10 is sent to a steam cracker unit 12. This stream 24 can be further separated in hydrogen, methane and C2/LPG, wherein the last fraction is further separated into separate C2, C3 and C4 streams, or into C2 on the one hand and a combined C3-C4 stream on the other hand.

The stream 30 rich in poly-aromatics is preferably further treated in an aromatics extraction unit 4, from which aromatics extraction unit 4 its bottom stream 28 is fed into said reaction area for ring opening 11 and its overhead stream 36 is fed into said steam cracker unit 12. Overhead stream 36 can also first be sent to isomerization/reverse isomerization unit 6. The heavy fraction 37 of reaction products formed in the reaction area for ring opening 11 is sent to the gasoline hydrocracker (GHC) unit 10, whereas the light fraction 41 of reaction products formed in the reaction area for ring opening 11 is sent to said steam cracker unit 12. An example of the aromatics extraction unit 4 is of the type of a distillation unit, a solvent extraction unit or molecular sieve. In case of a solvent extraction unit its overhead stream is washed for removal of solvent, wherein the thus recovered solvent is returned into said solvent extraction unit and the overhead stream thus washed being fed into said steam cracker unit 12.

In a preferred embodiment the bottom stream 25 from said distillation unit 2 is further fractionated in a vacuum distillation unit 5, in which vacuum distillation unit 5 said feed is separated in an overhead stream 27 and a bottom stream 35, wherein bottom stream 35 is fed into said hydrocracking area 9. In another embodiment bottom stream 25 can bypass the vacuum distillation unit 5 and be sent directly to the hydrocracking area 9.

Overhead stream 27 is sent to an aromatics extraction unit 4 or to reaction area for ring opening 11 via stream 44. As shown in the FIGURE, the overhead stream 27 of vacuum distillation unit 5 can bypass the aromatics extraction unit 4 so stream 27 is directly connected with reaction area for ring opening 11 via reference number 44. Feed 28 to reaction area for ring opening 11 can thus comprise stream 43 and 44, in which stream 43 originates from separator 22 and stream 44 originates from vacuum distillation unit 5, respectively, and the outlet stream of aromatics extraction unit 4. This means that aromatics extraction unit 4 relates to a preferred embodiment of the present invention.

As is clear from the FIGURE, the present process provides an option to completely bypass aromatics extraction unit 4, that is stream 8 can be sent directly to reaction area for ring opening 11 and both stream 27 and stream 30 can be sent, via stream 28, directly to reaction area for ring opening 11 as well. This provides highly beneficial possibilities regarding flexibility and product yield.

It is preferred to sent overhead stream 15 of distillation unit 2 to a separation section 3, in which separation section 3 overhead stream 15 is separated in a stream 16 rich in aromatics and a stream 14 rich in paraffins, wherein the stream 14 rich in paraffins is sent to steam cracker unit 12. The light fraction 13 of distillation unit 2 can be sent directly to steam cracker unit 12. If necessary, overhead stream 15 coming from distillation unit 2 can be divided in three different streams, i.e. a stream 32 as a feed for separation unit 3, a stream 23 as a feed for steam cracker unit 12 and stream 50 as a feed for gasoline hydrocracker (GHC) unit 10. From the FIGURE it is clear that both stream 50 and stream 23 bypass separation unit 3. One can say stream 13 is a "gas header" and stream 14 is a "liquid header".

In separation unit 3 stream 32 is separated in a stream 16 rich in aromatics and a stream 14 rich in paraffins, wherein stream 16 is sent to gasoline hydrocracker (GHC) unit 10 and stream 14 to an isomerization/reverse isomerization unit 6. The output 39 of isomerization/reverse isomerization unit 6 is sent to separator 45, or directly (not shown) to steam cracking unit 12. In a preferred embodiment stream 14 is directly sent to steam cracking unit 12, or a part of stream 14 is sent to a dehydrogenation unit 60 via stream 26. It is preferred to send only the C3-C4 fraction to the dehydrogenation unit 60, either as separate streams or as a combined C3 and C4 stream.

As is clear from the FIGURE, the present process provides an option to completely bypass separation unit 3, that is stream 15 can be sent directly to stream cracker unit 12, via stream 23 and unit 6, if appropriate, and stream 15 can be sent directly to gasoline hydrocracker (GHC) unit 10, via stream 50. This provides highly beneficial possibilities regarding flexibility and product yield.

In an embodiment of the present process, especially when using separator 45, it is preferred to separate C2-C4 paraffins from the gaseous streams 39 and 13 before sending these streams to steam cracker unit 12. In such a case the C2-C4 paraffins thus separated from the gaseous stream are sent to the furnace section of a steam cracker unit 12. In such an embodiment it is preferred to separate C2-C4 paraffins in individual streams, each stream predominantly comprising C2 paraffins, C3 paraffins and C4 paraffins, respectively, and feeding each individual stream to a specific furnace section of said steam cracker unit 12. In separator 45 the hydrogen and methane will be split off. For example, hydrogen will be sent to gasoline hydrocracker (GHC) unit 10, or hydrocracking area 9. Methane can be used a fuel, for example in the furnace section of steam cracker unit 12.

As schematically shown with separator 45 the gaseous streams 39, 13 can be subdivided into a stream 31 and a stream 26, wherein stream 26 is sent to dehydrogenation unit 60. It is preferred to send only the C3-C4 fraction to the dehydrogenation unit 60. Stream 31 is sent to the steam cracker unit 12. Such a stream 31 can be further separated into individual streams, each stream predominantly comprising C2 paraffins, C3 paraffins and C4 paraffins, respectively, wherein each individual stream is fed to a specific furnace section of said steam cracker unit 12.

In a steam cracker separation section (not shown) the reaction products of said steam cracking unit 12 are separated into an overhead stream, comprising predominantly C2-C6 alkanes, a middle stream 21 comprising C2-olefins, C3-olefins and C4-olefins, and a first bottom stream 33 and 34 comprising carbon black oil (CBO), cracked distillates (CD) and C9+ hydrocarbons, and a second bottom stream 42 comprising aromatic hydrocarbon compounds and non-aromatic hydrocarbon compounds. The overhead stream is preferably recycled to steam cracking unit 12. The stream 33 is recycled to said reaction area for ring opening 11 and stream 34 is recycled to hydrocracking reaction area 9. It is preferred to feed the second bottom stream 42, also called pygas containing stream, into the gasoline hydrocracker (GHC) unit 10. The reaction products 17 of gasoline hydrocracker (GHC) unit 10 can be separated in a BTX rich fraction and in heavy fraction.

In preferred embodiment hydrogen is recovered from the reaction products of steam cracking unit 12 and fed to gasoline hydrocracker (GHC) unit 10 and/or reaction area for ring opening 11. Furthermore, hydrogen can be recovered from the dehydrogenation unit 60 as discussed before and fed to the hydrocracker (GHC) unit 10 and/or the reaction area for ring opening 11. Hydrocracking reaction area 9 can be identified as a hydrogen consumer so the hydrogen recovered from the reaction products of steam cracking unit 12 and/or the dehydrogenation unit 60 can be sent to these units as well.

From the process scheme it is clear that LPG containing streams can be sent to a dehydrogenation unit 60 or to a steam cracking unit. It is preferred to send only the C3-C4 fraction to the dehydrogenation unit 60. The C2-C4 fractions can be separated from the LPG containing streams and the C2-C4 fractions thus obtained can be further separated in individual streams, each stream predominantly comprising C2 paraffins, C3 paraffins and C4 paraffins, respectively, and feeding each individual stream to a specific furnace section of said steam cracker unit. This separation into individual streams also applies for the dehydrogenation unit 60.

The present invention will now be more fully described by the following non-limiting Examples.

Example 1

The experimental data as provided herein were obtained by flow sheet modelling in Aspen Plus. The steam cracking kinetics were taken into account rigorously (software for steam cracker product slate calculations). Applied steam cracker furnace conditions:

Ethane and propane furnaces: COT (Coil Outlet temperature)=845° C. and steam-to-oil-ratio=0.37, C4-furnaces and liquid furnaces: Coil Outlet temperature=820° C. and Steam-to-oil-ratio=0.37.

For the feed hydrocracking, a reaction scheme has been used that is based on experimental data. For the aromatic ring opening followed by gasoline hydrocracking a reaction scheme has been used in which all multi aromatic compounds were converted into BTX and LPG and all naphthenic and paraffinic compounds were converted into LPG. The resid hydrocracker was modelled based on data from literature. For the dearomatization units, a separation scheme has been used in which normal- and iso-paraffins were separated from naphthenic and aromatic compounds.

Table 1 shows some physicochemical properties of Arabian light crude oil and Table 2 summarizes the properties of its corresponding atmospheric residue obtained after atmospheric distillation.

TABLE 1

Physicochemical properties of Arabian light crude oil

| PROPERTY | UNITS | VALUE |
|---|---|---|
| API gravity | API | 33.0 |
| Specific gravity | — | 0.8601 |
| Sulphur | wt. % | 2.01 |
| Nitrogen | ppm | 733 |
| Nickel | ppm | 8 |
| Vanadium | ppm | 16 |
| TAN | mg KOH/g | 0.05 |
| Pour point | ° F. | −5.8 |

| | VOLUME PERCENT | | | |
|---|---|---|---|---|
| BOILING RANGE | INITIAL | FINAL | YIELD | API GRAVITY |
| IBP/158° F. | 0.00 | 7.96 | 7.96 | 94.2 |
| 158/365° F. | 7.96 | 27.19 | 19.23 | 58.1 |
| 365/509° F. | 27.19 | 41.36 | 14.17 | 43.5 |
| 509/653° F. | 41.36 | 55.21 | 13.85 | 33.6 |
| 653/860° F. | 55.21 | 72.89 | 17.68 | 24.7 |
| 860/1049° F. | 72.89 | 83.30 | 10.41 | 18.2 |
| 1049+° F. | 83.30 | 100.00 | 16.70 | 7.1 |

TABLE 2

Physicochemical properties of Arabian light atmospheric resid

| PROPERTY | UNITS | VALUE |
|---|---|---|
| n-Paraffins | wt-% | 22.1 |
| i-Paraffins | wt-% | 16.7 |
| Naphthenes | wt-% | 27.6 |
| Aromatics | wt-% | 33.6 |
| Density 60° F. | kg/L | 0.9571 |
| IBP | ° C. | 342.7 |
| BP10 | ° C. | 364.9 |
| BP30 | ° C. | 405.4 |

TABLE 2-continued

Physicochemical properties of Arabian light atmospheric resid

| PROPERTY | UNITS | VALUE |
|---|---|---|
| BP50 | ° C. | 481.5 |
| BP70 | ° C. | 573.5 |
| BP90 | ° C. | 646.6 |
| FBP | ° C. | 688.9 |

In Example 1, Arabian light crude oil (1) is distilled in an atmospheric distillation unit (2). The fractions obtained from this unit comprise LPG (13), naphtha (15), gasoil (8) and resid (25) fractions. LPG is separated into methane, ethane, propane and butane and ethane, propane and butane are fed into a steam cracker unit (12) at their respective optimal cracking conditions mentioned above. Naphtha is sent to a dearomatization unit (3), where a stream rich in aromatic and naphthenic species (16) is separated from a stream rich in paraffins (14). In this example, the stream rich in aromatics and naphthenic species is sent to a gasoline hydrocracking unit (10) and the stream rich in paraffins (14) is sent to the steam cracking unit (12). The gasoline hydrocracking unit generates two streams: one rich in BTX (10) and one rich in LPG (24) that will be processed in the same way as the LPG cut generated by the atmospheric distillation unit. Gas oil is also sent to a dearomatization unit (4) where a stream rich in aromatic and naphthenic compounds (28) and a stream rich in paraffins (36) are generated. This latter stream is sent to a steam cracker (12) and the stream rich in aromatic and naphthenic species is sent to a ring opening process (11). This latter unit generates a stream rich in BTX (37) that will be sent to the gasoline hydrocracking unit (10) and one rich in LPG (41) that will be treated as other LPG cuts generated in other parts of the flowsheet. Finally, the resid (25) is sent to a vacuum distillation unit (5) where two different cuts are generated: vacuum residue (35) and vacuum gas oil (27). The latter stream is sent to a dearomatization unit (4) and it is further treated as previously defined gas oil cuts. The vacuum residue is sent to a hydrocracking reaction area (9) where the material is recycled until extinction and one gas oil cut is generated and sent to a dearomatization unit (4) and treated in the same way as the aforementioned gas oils. The products of the steam cracking unit are separated and the heavier cuts (C9 resin feed, cracked distillate and carbon black oil) are recycled back. More specifically, C9 resin feed stream is recycled to the gasoline hydrocracking unit (10), cracked distillate is sent to the aromatic ring opening process (11) and finally, the carbon black oil stream is sent to the hydrocracking reaction area (9). The results in terms of product yields in % wt. of crude are provided in table 3 as provided herein below. The products that are derived from the crude oil are divided into petrochemicals (olefins and BTXE, which is an acronym for BTX+ethyl benzene) and other products (hydrogen and methane). From the product slate of the crude oil the carbon efficiency is determined as: (Total Carbon Weight in petrochemicals)/(Total Carbon Weight in Crude).

Example 2

Example 2 is identical to Example 1 except for the following: Naphtha and gas oil cuts are not dearomatized but they are directly routed to the feed hydrocracking unit (10) and the aromatic ring opening process (11), respectively.

Example 3

Example 3 is identical to Example 1 except for the following: Paraffins and LPG generated by different units in the flowsheet is separated into methane, ethane, propane, butanes and other paraffin-rich stream. Ethane and the paraffin-rich stream (31) and further treated in a stream cracking unit (12) under the optimal cracking conditions for each stream. Furthermore, propane and butanes (26) are dehydrogenated into propylene and butenes (with ultimate selectivities of propane to propylene 90%, and n-butane to n-butene of 90% and i-butane to i-butene of 90%).

Example 4

Example 4 is identical to Example 2 except for the following: LPG generated by different units in the flowsheet is separated into methane, ethane, propane and butanes. Ethane (31) is further treated in a stream cracking unit (12) under its optimal cracking conditions. Furthermore, propane and butanes (26) are dehydrogenated into propylene and butenes (with ultimate selectivities of propane to propylene 90%, and n-butane to n-butene of 90% and i-butane to i-butene of 90%).

Example 5

Example 5 is identical to Example 1 except for the following: The stream rich in paraffins obtained from the dearomatization units (14) is further treated in a reverse isomerization unit (6) where iso-paraffins are converted into n-paraffins. This latter stream is further treated in a steam cracking unit (12).

Example 6

Example 6 is identical to Example 1 except for the following: Only the atmospheric residue (25) obtained after atmospheric distillation of Arabian light is further treated in the system. This stream (whose properties can be found in Table 2) could not be effectively processed in the steam cracker unit without the pretreatment steps that were mentioned in Example 1. Table 3 shows the corresponding product yields of the overall treatment. In this case, the product yields are not referred to the initial amount of crude but only to the atmospheric residue generated from that crude.

TABLE 3

| | Example 1 | Example 2 | Example 3 | Example 4 | Example 5 | Example 6 |
|---|---|---|---|---|---|---|
| Petrochemicals (wt.-% of feed) | | | | | | |
| Ethylene | 40% | 46% | 29% | 23% | 31% | 44% |
| Propylene | 15% | 11% | 31% | 45% | 31% | 16% |
| Butadiene | 4% | 2% | 3% | 1% | 3% | 5% |
| 1-butene | 1% | 1% | 5% | 7% | 5% | 1% |
| Isobutene | 1% | 0% | 1% | 1% | 1% | 1% |
| Isoprene | 0% | 0% | 0% | 0% | 0% | 0% |
| Cyclopentadiene | 1% | 1% | 1% | 0% | 1% | 1% |
| Benzene | 7% | 5% | 6% | 4% | 6% | 7% |
| Toluene | 8% | 8% | 8% | 7% | 8% | 5% |
| Xylene | 4% | 4% | 4% | 4% | 4% | 2% |
| Ethyl benzene | 0% | 1% | 0% | 1% | 0% | 0% |

TABLE 3-continued

| | Example 1 | Example 2 | Example 3 | Example 4 | Example 5 | Example 6 |
|---|---|---|---|---|---|---|
| Other components (wt.-% of feed) | | | | | | |
| Hydrogen *) | 2% | 3% | 2% | 4% | 2% | 2% |
| Methane | 15% | 18% | 8% | 4% | 8% | 16% |
| Carbon efficiency | 86% | 83% | 93% | 96% | 93% | 86% |

*) Excluding hydrogen from PDH and BDH units

The present inventors found that when comparing Example 3 vs. Example 1 the propylene production is boosted while avoiding "losing carbon and hydrogen" by means of CH4 production.

In examples 3 and 5, although gas crackers are used to process ethane, the BTXE production is kept almost as high as when using liquid steam crackers. This effect is due to the use of FHC and partial ring opening to preserve the already existing mono-aromatic molecules in the crude.

In addition, the present inventors found that the use of dearomatization combined with steam crackers (example 1 vs. example 2) does not increase ethylene production. The present inventors expect that when gasoil-like material is not dearomatized, it goes directly to partial ARO. In there, a lot of ethane and propane (also methane) are produced, which are feeds that generate even more ethylene than paraffinic liquid feeds that could be obtained by dearomatization. The combination of dearomatization and PDH/BDH yields more ethylene than when dearomatization is not considered. This comes with a penalty in methane production. The present inventors assume that the load to steam crackers is almost 2 times higher when using dearomatization. In addition, when using a Feed hydrocracking unit (FHC), the benzene-toluene-xylene ratios are changed from a benzene-rich stream (steam cracker without FHC) to a toluene-rich stream (with FHC). The results also show that reverse isomerization (example 5 compared to example 3) increases the ethylene production while maintaining propylene approximately constant.

Although not explicitly shown in the data, heavy material from steam cracker (C9 Resin Feed, Cracked Distillate and Carbon Black Oil) can be upgraded using this configuration.

The invention claimed is:

1. A process for upgrading refinery heavy residues to petrochemicals, comprising the steps of:

(a) separating a hydrocarbon feedstock in a distillation unit into a top overhead stream and a bottom stream, wherein the hydrocarbon feedstock consists of a combination of crude oil, kerosene, diesel, atmospheric gas oil (AGO), gas condensates, waxes, crude contaminated naphtha, vacuum gas oil (VGO), vacuum residue, atmospheric residue, naphtha and pretreated naphtha;

(b) feeding said bottom stream to a hydrocracking reaction area, wherein the process conditions prevailing in said hydrocracking area of step consist of a temperature of 300° C., a pressure of 300 kPa gauge and a Weight Hourly Space Velocity of 0.1 $h^{-1}$;

(c) separating reaction products, which are generated from said reaction area of step (b) into a stream rich in mono-aromatics and in a stream rich in poly-aromatics, wherein the stream rich in mono-aromatics consists of mono-aromatics having a boiling range of from 70° C. to 217° C., and wherein said stream rich in poly-aromatics consists of poly-aromatics having a boiling range of from 217° C. and higher;

(d) feeding said stream rich in mono-aromatics to a gasoline hydrocracker unit, wherein the process conditions prevailing in said gasoline hydrocracker unit consist of a reaction temperature of 300° C., a pressure of 0.3 MPa gauge and a Weight Hourly Space Velocity (WHSV) of 0.1 $h^{-1}$;

(e) feeding said stream rich in poly-aromatics to a ring opening reaction area; and; wherein the process conditions prevailing in said ring opening reaction area consist of a temperature of 100° C. and a pressure of 2 MPa together with from 50 to 300 kg of hydrogen per 1,000 kg of said stream rich in poly-aromatics over an aromatic hydrogenation catalyst and passing a resulting stream from said ring opening reaction area to a ring cleavage unit at a temperature 200° C. and a pressure from 1 Mpa together with from 50 to 200 kg of hydrogen per 1,000 kg of said resulting stream over a ring cleavage catalyst;

feeding a stream rich in paraffins separated from the top overhead stream in step a) into an isomerization unit and feeding the thus isomerized stream to a steam cracking unit;

separating reaction products of said gasoline hydrocracker of step (d) into an overhead gas stream comprising C2-C4 paraffins, hydrogen and methane and a bottom stream comprising aromatic hydrocarbon compounds and non-aromatic hydrocarbon compounds; feeding the overhead stream from the gasoline hydrocracker unit into the steam cracker unit;

separating the reaction products from the ring opening step (b) into a heavy fraction and a light fraction and feeding the heavy fraction of reaction products formed in the reaction area for ring opening into the gasoline hydrocracker unit; and feeding the light fraction of reaction products formed in the reaction area for ring opening into the steam cracker unit.

* * * * *